US010665215B2

(12) United States Patent
Jia

(10) Patent No.: US 10,665,215 B2
(45) Date of Patent: May 26, 2020

(54) EFFECTOR POWER ADAPTER AND EFFECTOR WORKING SYSTEM

(71) Applicant: He Jia, GuangDong (CN)

(72) Inventor: He Jia, GuangDong (CN)

(73) Assignee: Shenzhen Swiff Technology Co., Ltd., ShenZhen (CN)

( * ) Notice: Subject to any disclaimer, the term of this patent is extended or adjusted under 35 U.S.C. 154(b) by 352 days.

(21) Appl. No.: 15/727,756

(22) Filed: Oct. 9, 2017

(65) Prior Publication Data

US 2018/0102118 A1 Apr. 12, 2018

(30) Foreign Application Priority Data

Oct. 9, 2016 (CN) ..... 2016 2 11099782 U
Jan. 21, 2017 (CN) ..... 2017 2 00783123 U

(51) Int. Cl.
*G10H 1/00* (2006.01)
*H01R 13/66* (2006.01)
*H01R 25/00* (2006.01)

(52) U.S. Cl.
CPC ..... *G10H 1/0008* (2013.01); *G10H 1/0091* (2013.01); *H01R 13/665* (2013.01); *H01R 25/00* (2013.01); *G10H 2210/155* (2013.01); *G10H 2220/091* (2013.01); *G10H 2230/035* (2013.01)

(58) Field of Classification Search
CPC ..... G10H 1/0008; G10H 1/0091; G10H 2230/035; G10H 2220/091; G10H 2210/155; H01R 25/00; H01R 13/665
See application file for complete search history.

(56) References Cited

U.S. PATENT DOCUMENTS

2002/0159609 A1* 10/2002 Gibo ..... H03F 1/0244 381/120

FOREIGN PATENT DOCUMENTS

JP 2006085109 A * 3/2006

* cited by examiner

*Primary Examiner* — Jared Fureman
*Assistant Examiner* — Emmanuel Dominique
(74) *Attorney, Agent, or Firm* — Minder Law Group; Willy H. Wong

(57) ABSTRACT

The present invention provides an Effector Power Adapter for connecting an effector, the Effector Power Adapter includes a power supply module, at least one first voltage transformation module and multiple voltage output ports, wherein the voltage output port has at least one first voltage transformation output port. The first voltage transformation module is electrically connected to the power supply module and the first voltage transformation output port, and the first voltage transformation module controls the first voltage transformation output port to output numerically continuously adjustable voltages. The present invention further provides an Effector Working System, which has an effector and the above effector power adapter. The Effector Power Adapter and the Effector Working System provided by the present invention can apply different voltages to an effector to produce different sound effects, which enriches the playing effect and offers more musical creation space for music practitioners.

19 Claims, 8 Drawing Sheets

EFFECTOR POWER ADAPTER AND EFFECTOR WORKING SYSTEM

RELATED APPLICATIONS

This application claims benefit to China Patent Application No. CN2016211099782, filed Oct. 9, 2016; and China Patent Application No. CN2017200783123, filed Jan. 21, 2017.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention is related to the field of acoustic and musical instruments, and more particularly to an effector power adapter and an effector working system.

Related Art

Stringed instruments are an important branch of musical instruments, and, thanks to their delicate sound quality, are widely welcomed by music lovers. When playing music, usually special sound effects require effectors to make the sound more attractive.

When in use, an effector usually needs to be connected with an adapter, which supplies a suitable voltage to the effect. The power voltages required by effectors in the market include 9V and 12V, and existing effector power adapters supply a voltage of 9V or 12V to the effectors electrically connected therewith.

However, the electrical parameters of the internal electronic members of an effector slight change during the use of the effector, which affects the output of electrical signals of the effector. Thus, changes of the electrical signals of the effector make it difficult to obtain the timbre desired by users.

SUMMARY OF THE INVENTION

Accordingly, to overcome the problem in the prior art, the present invention provides an effector power adapter and an effector working system.

One object of the present disclosure is to provide an effector power adapter for connecting an effect. The effector power adapter includes a power supply module, at least one first voltage transformation module, and a multiple of voltage output ports. The voltage output port includes at least one first voltage transformation output port. The first voltage transformation module is electrically connected to the power supply module and the first voltage transformation output port, and the first voltage transformation module controls the first voltage transformation output port to output numerically continuously adjustable voltages.

Another object of the present disclosure is to provide an effector working system. The effector working system includes an effect, and an effect power adapter, the effect being electrically connected to the voltage output ports of the effect power adapter. The effector power adapter includes a power supply module, at least one first voltage transformation module, and a multiple of voltage output ports. The voltage output port includes at least one first voltage transformation output port. The first voltage transformation module is electrically connected to the power supply module and the first voltage transformation output port, and the first voltage transformation module controls the first voltage transformation output port to output numerically continuously adjustable voltages.

Compared with the prior art, the Effector Power Adapter of the present invention can output a voltage between a and b Volts and the output voltage can be continuously variable by providing at least one first voltage transformation output port. The effector power adapter of the present invention can be connected to different effectors. When the voltage required by a user's effector is between the continuously variable voltage range, the user can adjust the voltage output by the first voltage transformation output port so as to meet the requirement of the effector. In addition, the present invention can produce different sound effects to enrich the playing effect by applying different voltages to the effector. The same effector can produce different timbre by adjusting the voltage so as to meet musical practitioners' requirements for more timbre during musical creation.

The second voltage transformation output port can output at least two constant voltages, and a single voltage output port can output different constant voltages, thereby enhancing the multifunction of the voltage output port and improving the integration level of the product. Further, the user can directly and quickly change the electrical signals of the effector to acquire different mutability and unexpected timbre.

At least one constant voltage output port provided in the present invention can adapt to conventional effectors. When multiple electrical signal output ports are provided, the effector power adapter of the present invention can supply power to multiple effectors simultaneously.

The silica gel sheath provided to the outer side can not only function as a buffer and provide protection, but also prevent gathering of dust or water penetration of the multiple electrical signal output ports inside the effect power adapter. In other words, the silica gel sheath also has dustproof and waterproof functions. The hand-holding portion can prevent sweat or grease on the fingers from staining the bottom cover or the protruding end when performing operations, maintaining the dryness and cleanness of the power supply ports and the multiple electrical signal output ports. The multiple protruding strips provided to the silica gel ring can prevent damages to the effector power adapter when external objects collide with the silica gel ring, thereby providing buffer and protection.

The present invention also provides an effector working system having the advantages of rich timbre, good versatility and a long service life.

DETAILED DESCRIPTION OF THE INVENTION

In order to illustrate the objects, technical solutions and advantages of the present invention more clearly, detailed description is made to the present invention with reference to the accompanying drawings and embodiments. It should be understood that the specific embodiments described herein are only intended to illustrate rather than limit the present invention.

Figure 1:
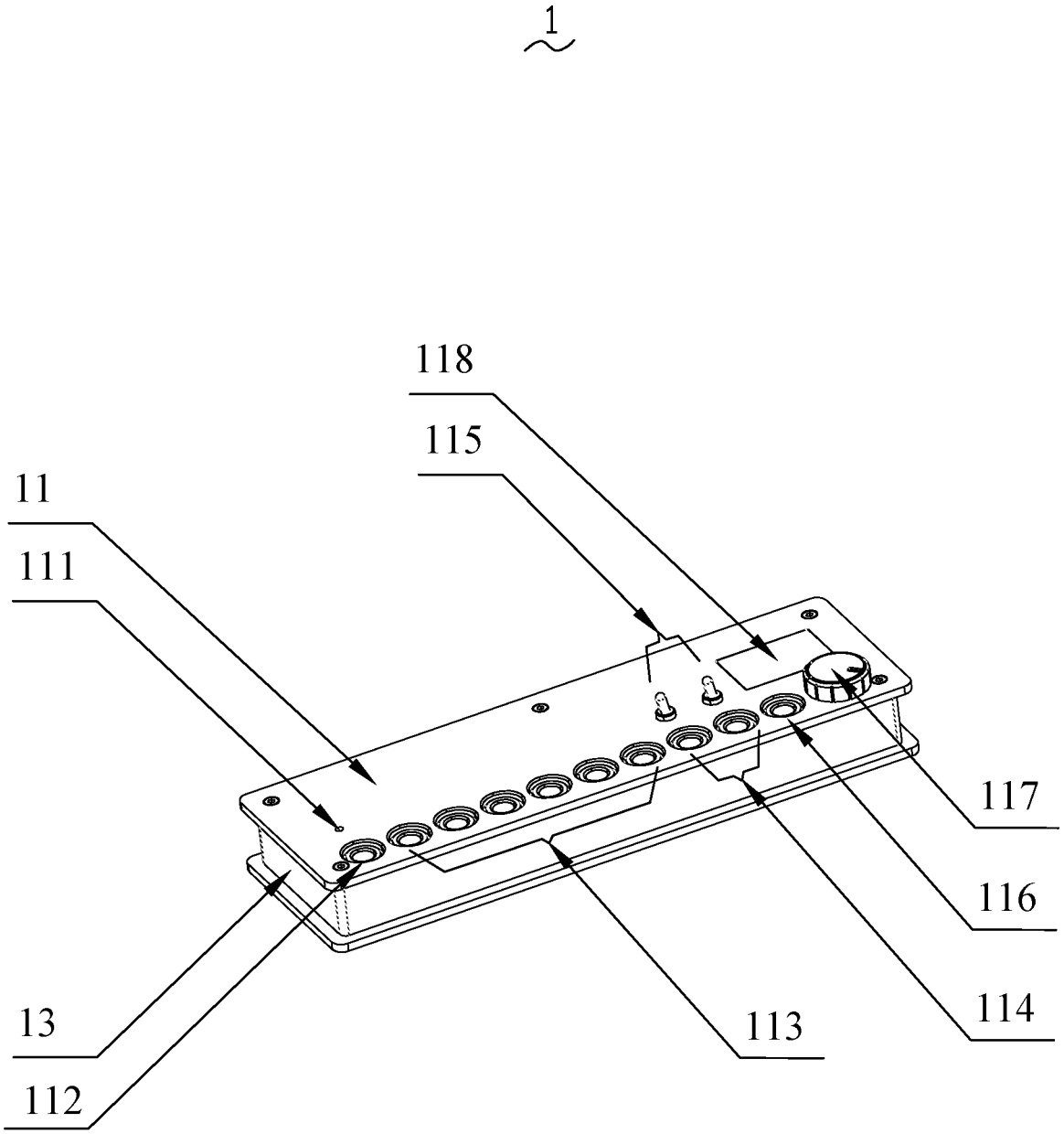
FIG. 1 is a perspective schematic view of an effector power adapter according to the present invention.

Referring to FIG. 1, the present invention provides an effector power adapter 1, whose one end is connected to a power source and whose other end to an effector. The power source supplies power to the effect via the effector power adapter 1.

The effector power adapter 1 includes a box cover 11 and a box body 13. The inside of the box body 13 is a chamber, which is covered by the box cover 11 snap-fits the box body 13 (in all the embodiments, the positional terms, such as "upper", "lower", "left", "right", "inside" and "outside", only mean the relative positions in the drawings rather than absolute positions) so that the chamber is sealed or substantially sealed relative to the outside of the effector power adapter 1.

The box cover 11 is provided with an indication lamp 111 for indicating whether the power source normally supplies power to the effector power adapter 1, and a power supply port 112 to be connected to the power source. The box cover 11 is further provided with multiple electrical signal output ports including six constant voltage output ports 113, one first voltage transformation output port 116 and two second voltage transformation output ports 114. Preferably, the nine electrical signal output ports are arranged on a line. Each constant voltage output port 113 outputs a constant voltage and a constant current. Preferably, the constant voltage output port 113 in the present invention outputs electrical signals of a constant voltage of 9V and a constant current of 100 mA. The box cover 11 is further provided with an adjusting knob 117 and a display screen 118, which are electrically connected to the first voltage transformation output port 116, respectively. The first voltage transformation output port 116 can output a constant current and variable voltages. Preferably, the first voltage transformation output port 116 in the present invention outputs a current of 300 mA and a voltage of 3V-24V, and the output voltage is numerically continuously adjustable. The adjusting knob 117 is configured to manually adjust the voltage output by the first voltage transformation output port 116, and the display screen to display the voltage output by the first voltage transformation output port 116. In the present embodiment, the adjusting knob 117 is of a knob type. As a modification, the adjusting knob 117 may be of a sliding type or other types that may continuously change values. The box cover 11 is further provided with two second voltage transformation control ends 115, which are multi-way switches and are electrically connected to two second voltage transformation output ports 114, respectively. The second voltage transformation control end 115 is configured to change the voltage output values of the two second voltage transformation output ports 114. The second voltage transformation output ports 114 provide constant currents and variable voltages to the effect. The variable voltage output by the second voltage transformation output port 114 is preferably numerically discretely adjustable. It should be understood that numerically discretely adjusting the voltage means non-continuously adjusting the voltage. Preferably, each second voltage transformation output port 114 in the present invention can output a voltage of 9V or 12V, and each second voltage transformation control end 115 controls the voltage of one corresponding second voltage transformation output port 114. When the second voltage transformation control end 115 is pushed to the left side, the corresponding second voltage transformation output port 114 outputs a constant voltage of 9V and a constant current of 300 mA or 100 mA. When the second voltage transformation control end 115 is pushed to the right side, the corresponding second voltage transformation output port 114 outputs a constant voltage of 12V and a constant current of 300 mA or 100 mA.

As a modification, the number of the constant voltage output ports 113 is not limited, and may be at least one. The voltage output value of the at least one constant voltage output ports 113 is not limited to 9V, and may be any fixed voltage value. Further, the voltage output values of the at least one constant voltage output ports 113 may be the same or different, and may be set according to the actual requirements.

As a further modification, the voltage output value of the first voltage transformation output port 116 is between a and b Volts and can be continuously variable. The numerals a and b are any unequal integers, and the number of the first voltage transformation output port 116 is not limited.

As a yet further modification, the adjusting direction and manner of the second voltage transformation control end 115 are not limited. A constant voltage may be selected from multiple values in any other manner. Preferably, a constant voltage of 9V or 12V is selected from these two values by a button operation. As a yet further modification, the output voltage of the second voltage transformation control end 115 may include multiple constant voltage values, such as three. One constant voltage may be selected from the three constant voltage values by operating the second voltage transformation control end 115, and the multiple constant voltage values are not limited. As a yet further modification, the number of the output voltage of the second voltage transformation control end 115 is not limited, and may be at least one. The number and value of adjustable voltages of the second voltage transformation control end 115 is not limited, and may be set according to the actual requirements.

As a yet further modification, the output currents of the constant voltage output ports 113, the first voltage transformation output port 116 and the second voltage transformation output ports 114 are variable, but are preferably constant.

Figure 2A:
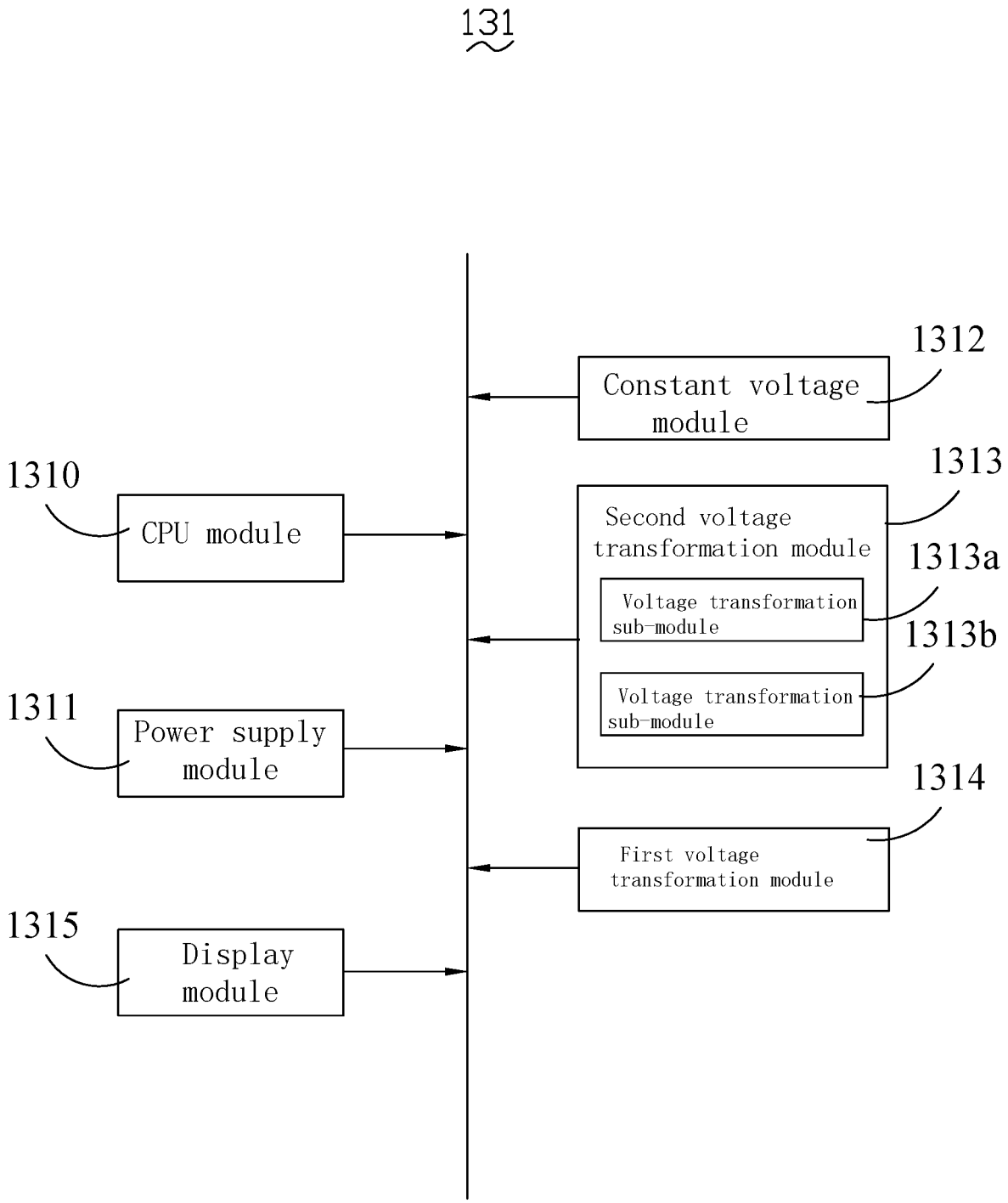
FIG. 2A is a circuit module view of an integrated circuit board inside the effector power adapter according to the present invention.

Referring to FIG. 2A, preferably, an integrated circuit board 131 is provided inside the box body 13, and is integrated with a CPU module 1310, a power supply module 1311, a constant voltage module 1312, a second voltage transformation module 1313, a first voltage transformation module 1314 and a display module 1315. The power supply module 1311, the constant voltage module 1312, the second voltage transformation module 1313, the first voltage transformation module 1314 and the display module 1315 are electrically connected to the CPU module 1310, respectively, and the display module 1315 is electrically connected to the first voltage transformation module 1314. The CPU module 1310 is configured to process the signal transmission among the respective modules. The power supply module 1311 is configured to be connected with a power source, and is electrically connected with a power supply port 12 on the box cover 11. The constant voltage module 1312 is configured to control output of a constant voltage, and is electrically connected with the constant voltage output ports 113 on the box cover 11. The second voltage transformation module 1313 is configured to control output of a voltage value selected from multiple candidates, and includes at least two voltage transformation sub-modules of different voltage transformation ratios, namely, voltage transformation sub-modules 1313*a* and 1313*b*, which provide different constant voltages to the second voltage transformation output ports 114 respectively. The second voltage transformation output ports 114 and the second voltage transformation control ends 115 on the box cover 11 are electrically connected to the second voltage transformation module 1313. The first voltage transformation module 1314 is configured to control numerically continuously adjustable voltage output, and is electrically connected to the first voltage transformation output port 116 and adjusting knob 117 on the box cover 11. The display module 1315 is configured to display the voltage value output by the first voltage transformation output port 1314, and is electrically connected to the display screen 118 on the box cover 11.

Figure 2B:
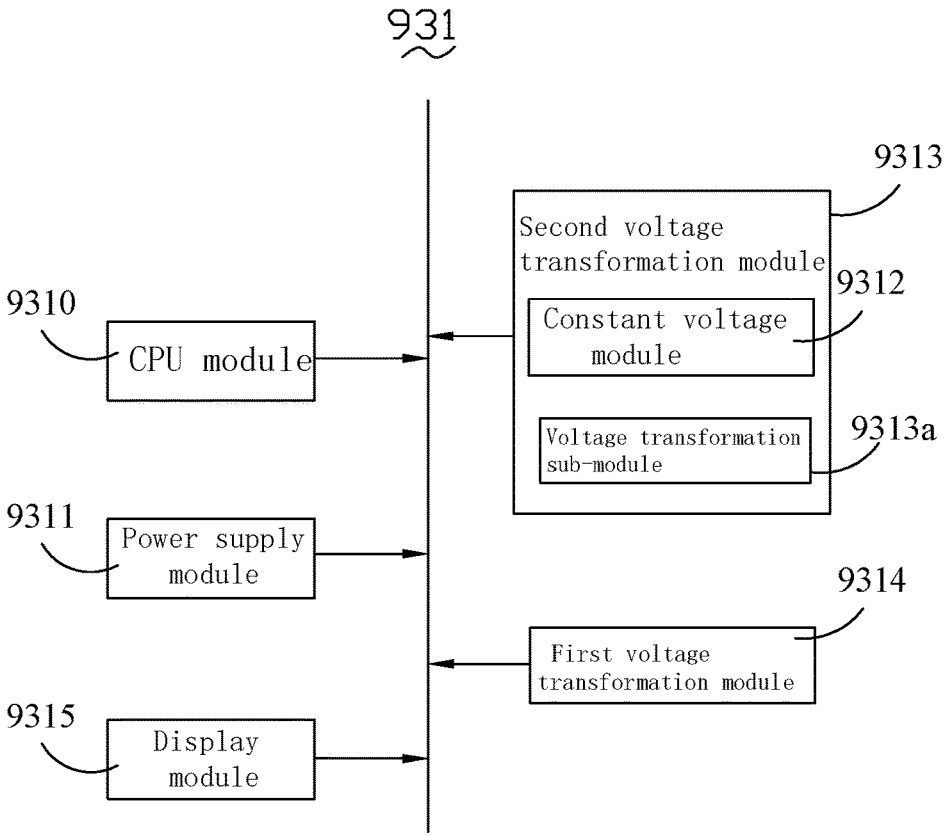
FIG. 2B is a circuit module view of a variation of the integrated circuit board of FIG. 2A.

Referring to FIG. 2B, as a modification of the integrated circuit board 131, an integrated circuit board 931 is integrated with a CPU module 9310, a power supply module 9311, a second voltage transformation module 9313, a first voltage transformation module 9314 and a display module 9315. The integrated circuit board 931 differs from the integrated circuit board 131 only in that the second voltage transformation module 9313 includes a constant voltage module 9312 and a voltage transformation sub-module 9312*a*, which provide different constant voltages and identical or different constant currents to the second voltage transformation output ports 114 respectively. It can be understood that the constant voltage module 9312 provides constant voltage and constant current signals to the constant voltage output ports 113, and serves as a voltage transformation sub-module of the second voltage transformation module 9313 to provide one of multiple constant voltages to the second voltage transformation output ports 114.

Figure 3:
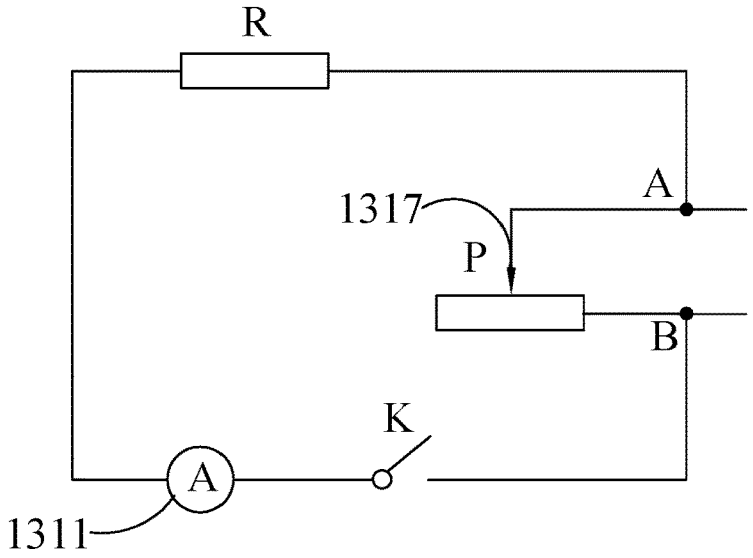
FIG. 3 is a circuit principle view of a first voltage transformation module of FIG. 2A.

Referring to FIG. 3, the power supply module 1311 provides constant current signals. It should be understood that the constant current signals may be provided by a suitable circuit, or the power supply module 1311 may serve as a constant current signal source. The present embodiment is exemplified in which the power supply module 1311 serves as a constant current signal source. The first voltage transformation module 1314 is a relay. Preferably, the first voltage transformation module 1314 includes a fixed resistor R and a sliding rheostat P, which are connected in series with the power supply module 1311, and the power supply module 1311 provides constant current signals to the series circuit. The sliding rheostat P includes an adjusting end 1317. The voltage of the resistor of the sliding rheostat P connected to the series circuit is $V_{AB}$, which is supplied to the first voltage transformation output port 116. Sliding of the adjusting end 1317 relative to the point B causes changes to the voltage of the series circuit, so that the voltage $V_{AB}$ on the fixed resistor R is changed continuously. The voltage on the fixed resistor R is a changing voltage end 1316. The adjusting knob 117 on the box cover 11 is connected to the adjusting end 1317, which slides along with the adjustment of the adjusting knob 117 to change the resistance of the sliding rheostat P in the series circuit. In this way, the voltage $V_{AB}$ is changed to control the voltage output value of the first voltage transformation output port 116 connected with the power supply module 1311. As a modification, the fixed resistor R may be omitted. Preferably, the number of the fixed resistor R is at least one, and may be set according to the actual requirements.

When the effector power adapter 1 is in use, the user connects the power supply port 112 to the power source via a cable, and then the indication lamp 111 is lit. When the voltage required by the effector to be connected by the user is 9V, the effector is connected to any of the constant voltage output ports 113 or any of the second voltage transformation output ports 114 and an output voltage of 9V, which is selected via the second voltage transformation control end 115. When the voltage required by the effector to be connected by the user is 12V, the effector is connected to any of the second voltage transformation output ports 114 and an output voltage of 15V, which is selected via the second voltage transformation control end 115. When the voltage required by the effect to be connected by the user is between 3V and 24V, the effector is connected to the first voltage transformation output port 116, and a voltage within this range is generated by manually rotating the adjusting knob 117 and is displayed on the display screen 18 at the same time. When the user wants the effector to produce a different sound effect using a different voltage, the user may try different sound effects produced by the effector by selecting different voltages via the adjusting knob 117. The user may also insert the effector power adapter 1 into multiple effects simultaneously, and the specific electrical signal output port may be selected according to the voltage required by the effector.

The effector power adapters in the market all provide power of 9V, while the output voltage set for the first voltage transformation output port 116 in the present embodiment is 3V-24V, and preferably 3V-9V or 9V-24V or 12V-24V. When the output voltage of the first voltage transformation output port 116 is between 3V and 8V, the effector connected with the effector power adapter will be in a low voltage power supply state (or an undervoltage working mode). However, as different voltages have different influence to the output timbre of musical instruments, the effect in a low voltage power supply state can output different timbre so as to meet musical practitioners' requirements for more timbre during their musical creation. Thus, more possible creation space is offered to musical practitioners. The voltage in the low voltage power supply state may be preferably 4V-6V or 3.5V-4.5V. On the contrary, when the output voltage of the first voltage transformation output port 116 is between 10V and 24V, the effector connected with the effector power adapter will be in a high voltage power supply state (or an overvoltage working mode). The effector in a high voltage power supply state can output different timbre so as to meet musical practitioners' requirements for more timbre during their musical creation. The voltage in the high voltage power supply state may be preferably 10V-24V, and further preferably 12V-24V or 13V-24V or 18V-20V.

In the present invention, the voltage output port preferably outputs constant currents. When the output current is constant and the output voltage is constant or variable, the effect can not only work normally but also can produce different timbre.

Figure 4:
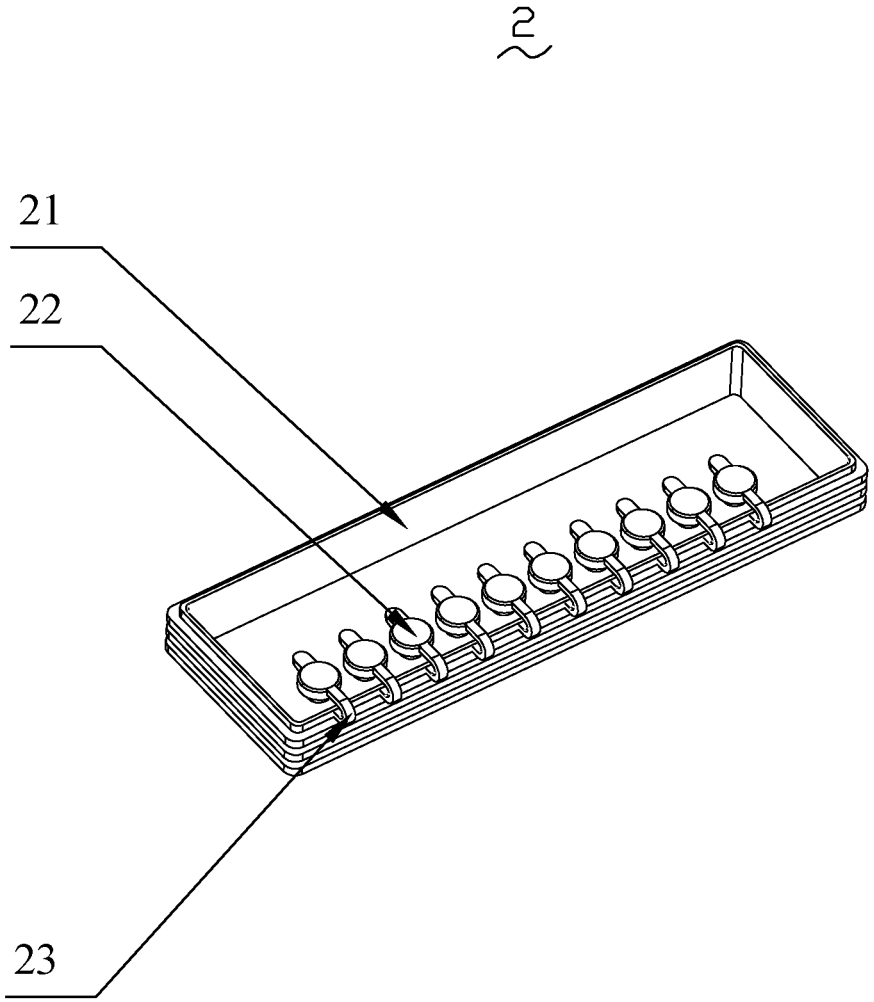
FIG. 4 is a perspective schematic view of a silica gel sheath arranged outside the present invention.

Referring to FIG. 4, the effector power adapter 1 according to the present invention further includes a silica gel sheath 2 for encapsulating the same. The silica gel sheath 2 includes a silica gel ring 21, multiple buckle covers 22 and multiple connecting portions 23. Each buckle cover 22 is movably connected to the silica gel ring 21 via the connecting portion 23. The number of buckle covers 22 is the same as the sum of the number of the electrical signal output ports and the power supply ports of the effector power adapter 1.

Figure 5:
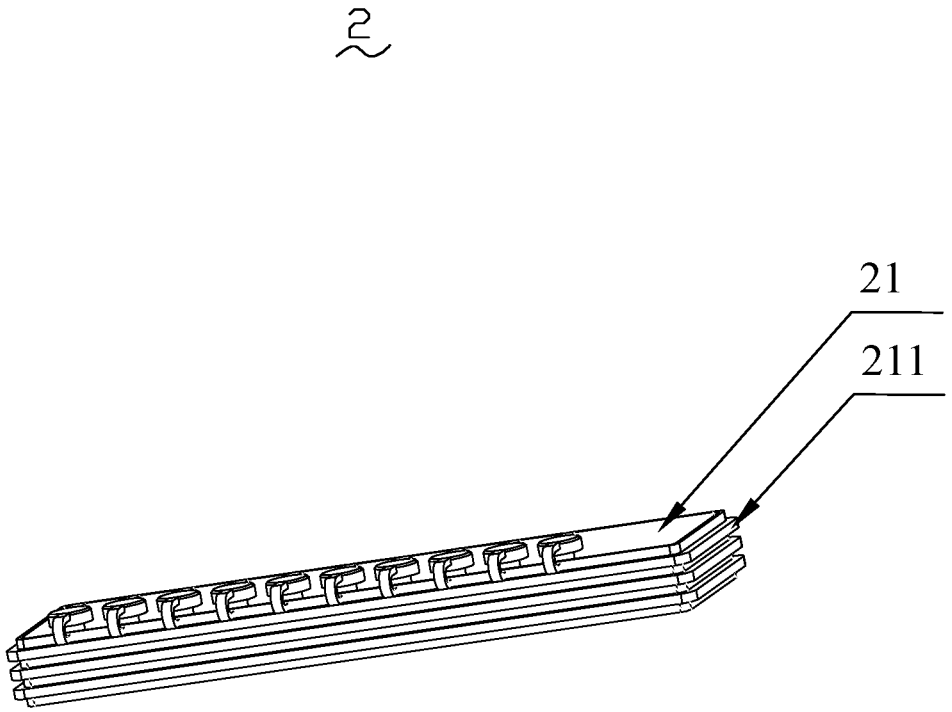
FIGS. 5-6 are perspective schematic views of the silica gel sheath of FIG. 4 viewed from other angles.

Referring to FIG. 5, the silica gel ring 21 is annular, and is provided with multiple rings of protruding strips 211 at an outer side thereof. When an external object collides with the silica gel ring 21, the protruding strips 211 can provide buffer and protection.

Figure 6:
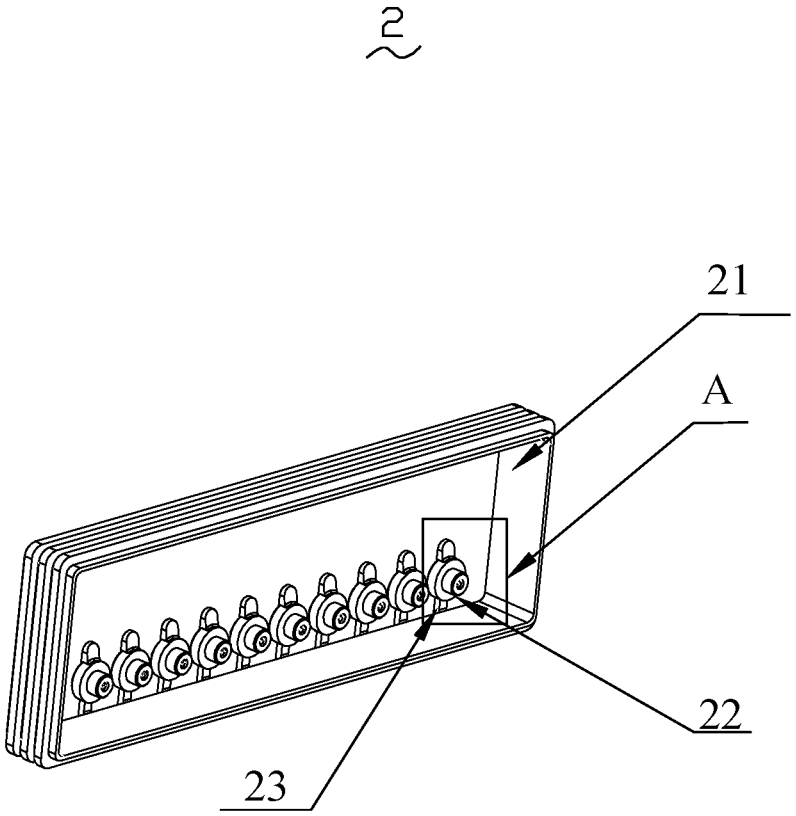
Figure 7:
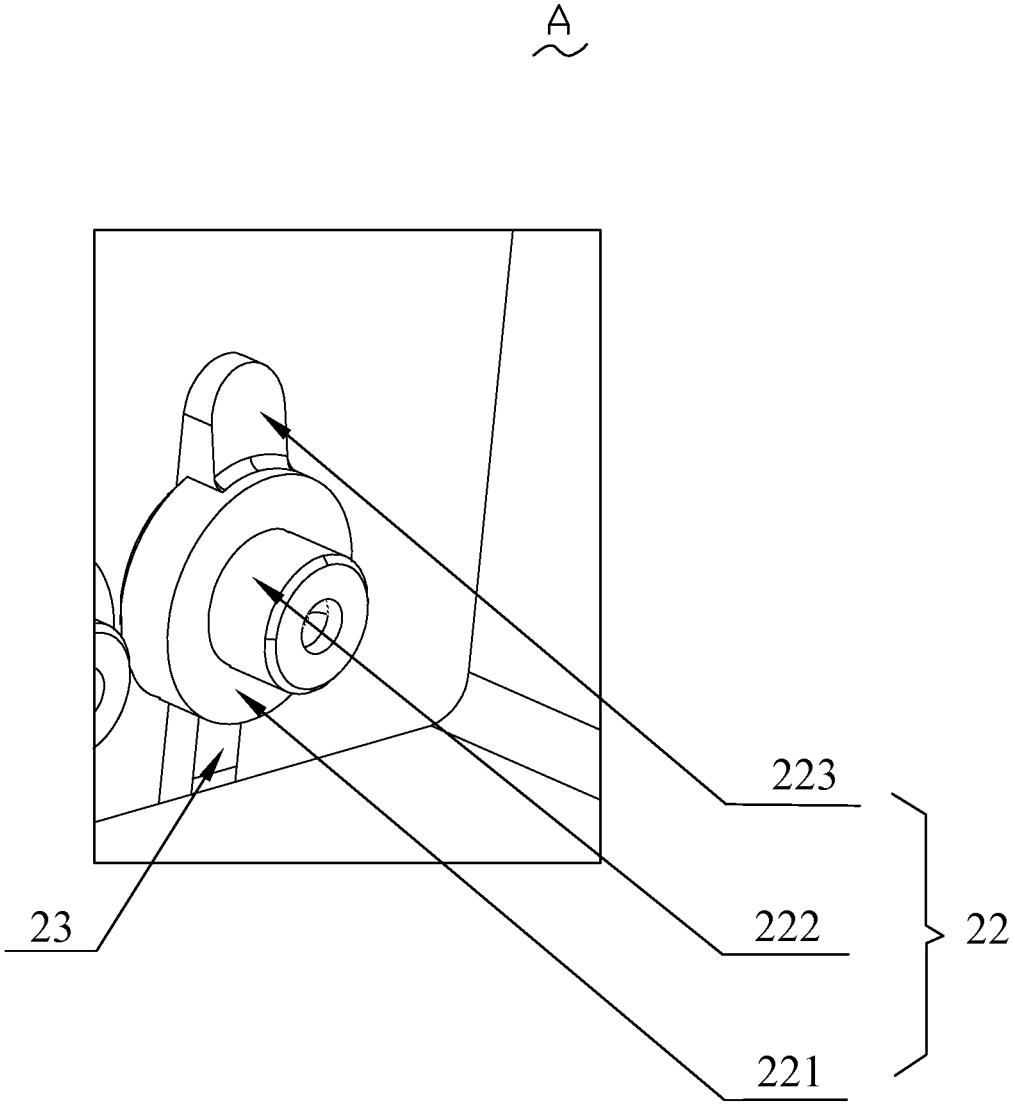
FIG. 7 is an enlarged schematic view of the part A in FIG. 6.
Figure 8:
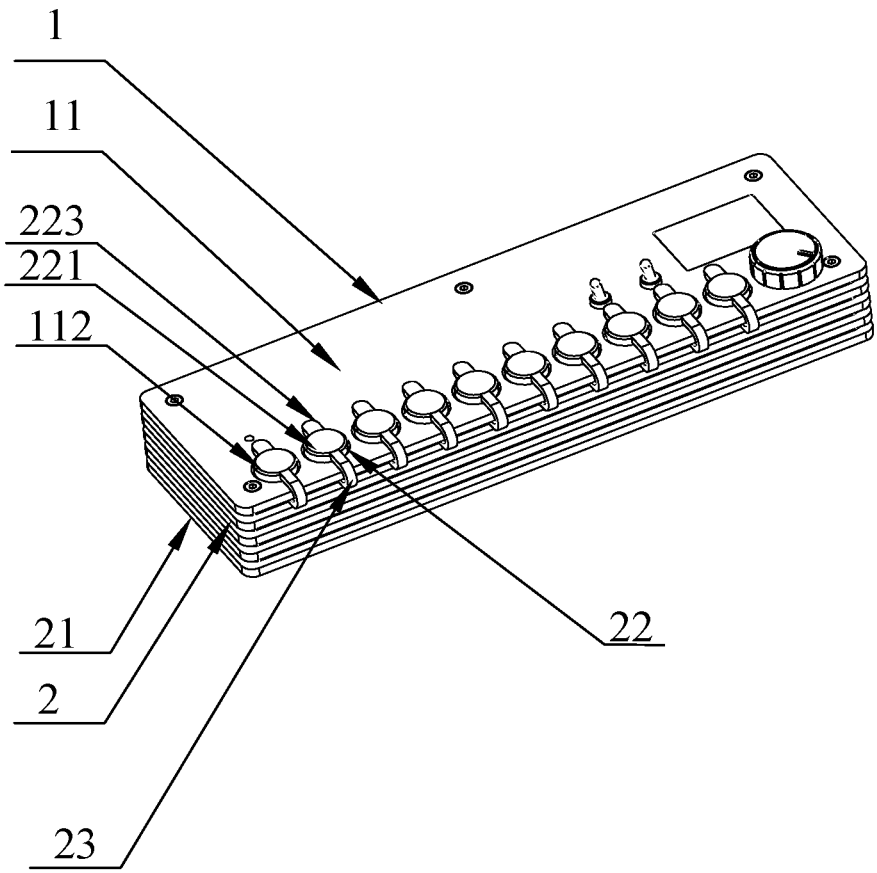
FIG. 8 is a schematic view of the effector power adapter encapsulated by the silica gel sheath.

Referring to FIGS. 6-7, the buckle cover 22 includes a bottom cover 221, a protruding end 222 and a hand-holding portion 223. The bottom cover 22 is sheet-shaped and has a size slightly greater than the size of a corresponding electrical signal output port or of the power supply port 112. The protruding end 222 is located below the bottom cover 221 and has a size smaller than or equal to the size of a corresponding electrical signal output port or of the power supply port 112. The hand-holding portion 223 is located at an edge of the bottom cover 221. As a modification, the hand-holding portion 223 may also be provided on a surface of the bottom cover 221 away from the protruding end 222, or may be omitted.

Referring to FIG. 7, when the silica gel sheath 2 is fitted over the effector power adapter 1, the silica gel ring 21 is fitted over the box body 13, and the buckle covers 22 correspond to the power supply ports 112 on the box cover 11 and the multiple electrical signal output ports respectively. When fingers hold the hand-holding portion 223, the bottom cover 22 is buckled on the power supply port 112 or the electrical signal output port on the box cover 11, and the protruding end 222 is located inside the electrical signal output port and the power supply port 112, so that the entire bottom cover 22 covers the electrical signal output port and the power supply port 112.

An effector working system includes an effector and the above effector power adapter, the effector being electrically connected to the voltage output ports of the effector power adapter.

The foregoing are only preferred embodiments of the present invention, and do not intend to limit the present invention. Any variation, equivalent substitution and modification that fall within the principle of the present invention should be embraced by the protective scope of the present invention.

What is claimed is:

1. An Effector Power Adapter for connecting an effector, comprising:

a power supply module;

at least one first voltage transformation module; and multiple voltage output ports;

wherein the multiple voltage output ports comprise at least one first voltage transformation output port, the first voltage transformation module is electrically connected to the power supply module and the first voltage transformation output port, and the first voltage transformation module controls the first voltage transformation output port to output numerically continuously adjustable voltages; and wherein the effector power adapter further comprises a constant voltage module, the multiple voltage output ports comprise at least one constant voltage output port, the constant voltage module is electrically connected to the power supply module and the at least one constant voltage output port, and the constant voltage module controls the at least one constant voltage output to output a constant voltage.

2. The Effector Power Adapter according to claim 1, wherein an output voltage of the first voltage transformation output port is 3-24V.

3. The Effector Power Adapter according to claim 2, wherein the output voltage of the first voltage transformation output port is 3-8V at an undervoltage working mode.

4. The Effector Power Adapter according to claim 2, wherein the output voltage of the first voltage transformation output port is 10-24V at an undervoltage working mode.

5. The Effector Power Adapter according to claim 2, wherein the multiple voltage output ports output constant current signals, respectively.

6. The Effector Power Adapter according to claim 1, wherein the first voltage transformation output port provides an undervoltage working mode and/or an overvoltage working mode for the effector.

7. The Effector Power Adapter according to claim 1, wherein the power supply module provides a constant current signal; the first voltage transformation module comprises a sliding rheostat, which is connected in series with the power supply module to form a series circuit; a resistor of the sliding rheostat, which is connected to the series circuit is electrically connected to the first voltage transformation output port and provides an output electrical signal to the first voltage transformation output port; and the sliding rheostat comprises an adjusting end, which changes a resistance value of the resistor of the sliding rheostat which is connected to the series circuit, so as to change the output electrical signal of the first voltage transformation output port.

8. The Effector Power Adapter according to claim 7, further comprising an adjusting knob and a display screen, wherein the display screen is electrically connected to the first voltage transformation module, the adjusting knob is connected to the adjusting end of the sliding rheostat and is configured to manually adjust the voltage output by the first voltage transformation output port, and the display screen is configured to display a voltage value output by the first voltage transformation output port.

9. The Effector Power Adapter according to claim 1, wherein the constant voltage output port outputs a voltage of 9V.

10. The Effector Power Adapter according to claim 1, wherein the Effector Power Adapter further comprises a second voltage transformation module and a second voltage transformation control end; the multiple voltage output ports comprise at least one second voltage transformation output port; the second voltage transformation module is electrically connected to the second voltage transformation output port and the second voltage transformation control end; and the second voltage transformation control end controls the second voltage transformation output port to output at least two constant voltages via the second voltage transformation module.

11. The Effector Power Adapter according to claim 10, wherein the second voltage transformation output port outputs discrete voltage values.

12. The Effector Power Adapter according to claim 11, wherein the voltage value is 9V or 12V.

13. The Effector Power Adapter according to claim 10, wherein the second voltage transformation module comprises at least two voltage transformation sub-modules of different voltage transformation ratios; the second voltage transformation control end is connected between the second voltage transformation module and the second voltage transformation output port; and the second voltage transformation control end controls the second voltage transformation output port to be electrically connected to one voltage transformation sub-module of the second voltage transformation module.

14. The Effector Power Adapter according to claim 13, wherein the second voltage transformation control end is a multiway switch.

15. The Effector Power Adapter according to claim 13, wherein the multiple voltage output ports comprise at least one constant voltage output port electrically connected to one voltage transformation sub-module of the second voltage transformation module.

16. The Effector Power Adapter according to claim 1, further comprising a box body, a box cover and a silica gel sheath, wherein the box cover covers the box body, the power supply module and the first voltage transformation module are received in the box body, the multiple voltage output ports are provided in the box cover, the silica gel sheath comprises a silica gel ring, a connecting portion and a buckle cover, the buckle cover is movably connected to the silica gel ring via the connecting portion, the silica gel ring is fitted over the box body, and the buckle cover is configured to buckle the multiple voltage output ports.

17. The Effector Power Adapter according to claim 16, wherein the silica gel ring is a annular and is provided with multiple rings of protruding strips at an outer side thereof.

18. The Effector Power Adapter according to claim 17, wherein the buckle cover comprises a bottom cover and a protruding end; the bottom cover is sheet-shaped and has a size greater than the size of a corresponding voltage output port; the protruding end is located below the bottom cover and has a size smaller than or equal to the size of a corresponding voltage output port; and the bottom cover comprises a hand-holding portion located at an edge of the bottom cover or provided on a surface of the bottom cover away from the protruding end.

19. An Effector Working System, comprising:

an effector; and an effector power adapter, the effector being electrically connected to multiple voltage output ports of the effect power adapter;

wherein the Effector Power Adapter comprises a power supply module, at least one first voltage transformation module, and the multiple voltage output ports, the multiple voltage output ports comprising at least one first voltage transformation output port, the first voltage transformation module being electrically connected to the power supply module and the first voltage transformation output port, and the first voltage transformation module controlling the first voltage transformation output port to output numerically continuously adjustable voltages; and wherein the effector power adapter further comprises a constant voltage module; the multiple voltage output ports comprise at least one constant voltage output port; the constant voltage module is electrically connected to the power supply module and the at least one constant voltage output port; and the constant voltage module controls the at least one constant voltage output to output a constant voltage.

* * * * *